US010149545B2

(12) United States Patent
Bergling

(10) Patent No.: US 10,149,545 B2
(45) Date of Patent: Dec. 11, 2018

(54) STAND FOR A SITTING OR LYING FURNITURE AND FURNITURE INCLUDING SAID STAND

(71) Applicant: Frelabs AB, Skäret (SE)

(72) Inventor: Fredrik Bergling, Skäret (SE)

(73) Assignee: FRELABS AB (SE)

( * ) Notice: Subject to any disclaimer, the term of this patent is extended or adjusted under 35 U.S.C. 154(b) by 0 days.

(21) Appl. No.: 15/312,956

(22) PCT Filed: May 19, 2015

(86) PCT No.: PCT/SE2015/050565
§ 371 (c)(1),
(2) Date: Nov. 21, 2016

(87) PCT Pub. No.: WO2015/178837
PCT Pub. Date: Nov. 26, 2015

(65) Prior Publication Data

US 2017/0188709 A1 Jul. 6, 2017

(30) Foreign Application Priority Data

May 21, 2014 (SE) ..... 1430075

(51) Int. Cl.
*A47C 4/28* (2006.01)
*A47D 1/02* (2006.01)
(Continued)

(52) U.S. Cl.
CPC ..... *A47C 4/286* (2013.01); *A47C 9/105* (2013.01); *A47D 1/02* (2013.01); *A47D 9/005* (2013.01)

(58) Field of Classification Search
USPC ..... 248/165, 166, 434, 435, 168, 169, 171, 248/436, 439, 173, 440
See application file for complete search history.

(56) References Cited

U.S. PATENT DOCUMENTS 517,929 A * 4/1894 March
564,129 A 7/1896 Wade
(Continued)

FOREIGN PATENT DOCUMENTS

CN 202184457 U 4/2012
FR 2963220 A1 2/2012
GB 934976 A 8/1963

*Primary Examiner* — Alfred J Wujciak
(74) *Attorney, Agent, or Firm* — Condo Roccia Koptiw LLP

(57) ABSTRACT

This invention relates to a stand (FIG. 1) for a sitting or lying furniture, which stand is adjustable into a folded position for storage (FIG. 4) and transport and one or more extended usage positions. The stand has at least three legs (2), that in the usage position extend obliquely downward and outward and at least three arms (3), that in the usage position extends obliquely upward and outward and are arranged to support a canvas shaped sitting or lying module (FIG. 5-8). Arms and legs are at their lower and upper sections pivotally attached to a connecting hub (1*a*). A locking mechanism is attached to the connecting hub or the control means (4,8) and is arranged to restrict the legs movement outwards in the usage position. In the folded position the arms and legs extend substantially upward. The invention also refers to a sitting or lying furniture that includes such a stand.

9 Claims, 6 Drawing Sheets

Figure 1:
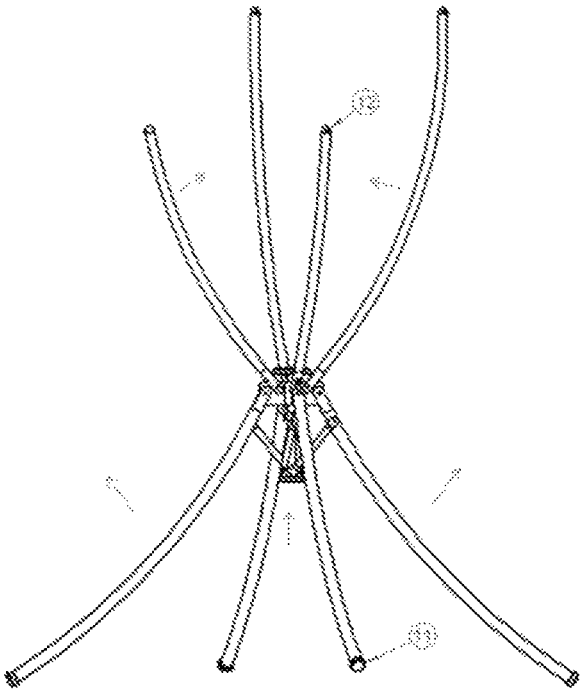

(51) Int. Cl.
*A47D 9/00* (2006.01)
*A47C 9/10* (2006.01)

(56) References Cited

U.S. PATENT DOCUMENTS

| | | | | | |
|---|---|---|---|---|---|
| 882,468 | A | | 3/1908 | Huebner et al. | |
| 1,166,386 | A | | 12/1915 | Perrin | |
| 1,344,431 | A | * | 6/1920 | Albertie | A47C 4/286 248/435 |
| 1,527,941 | A | * | 2/1925 | Weidner | A47C 9/105 248/170 |
| 3,115,849 | A | * | 12/1963 | Johnson | A47B 9/08 108/148 |
| 6,575,422 | B1 | * | 6/2003 | Zheng | A47B 3/04 108/118 |
| 2006/0049319 | A1 | * | 3/2006 | May | G10D 13/026 248/166 |
| 2006/0086869 | A1 | * | 4/2006 | Hsieh | F16M 11/046 248/171 |
| 2010/0314926 | A1 | | 12/2010 | Chesness | |
| 2011/0156449 | A1 | * | 6/2011 | Obolewicz | A47C 3/18 297/16.2 |

* cited by examiner

STAND FOR A SITTING OR LYING FURNITURE AND FURNITURE INCLUDING SAID STAND

CROSS REFERENCE TO RELATED APPLICATIONS

This application is the National Stage Entry under 35 U.S.C. § 371 of Patent Cooperation Treaty Application No. PCT/SE2015/050565, filed May 19, 2015, which claims priority to Swedish Application No. 1430075-0, filed May 21, 2014, the contents of which are hereby incorporated by reference herein.

TECHNICAL AREA

This invention refers to a stand for a sitting/lying furniture, where the stand is adjustable into a folded position for storage and transportation, as well as an erect unfolded usage position and have at least three legs, that when in the usage position extends obliquely downward and outward, and at least three arms, which in the usage position extends obliquely upward and outward arranged to carry a canvas module for sitting or lying.

CURRENT TECHNICAL STANDPOINT

To provide a safe place for the infant to sit/lie during the various stages of the day, a variety of products is needed, a high chair when eating, a bouncer to sit in when the infant is not eating, and a bed to lie in. As long as you are in your home and have relatively ample space, a solution with three different pieces of furniture is acceptable. (albeit with some gaps, there is no really good product that allows the infants to be within reach at a the dining table.) The problem is evident when you shall travel with the infant or visit friends who cannot provide the necessary seating and lying arrangements for the infants.

There are folding chairs and beds on the market, but if you bring all products mentioned above, it would weigh about 15-20 kg and would have the same size as two suitcases. Thus, to fly, use public transportations or ride in a smaller car will be difficult.

Should you visit someone only for a short period, it is simply not practical to bring all pieces of furniture or even parts of them.

Today's folding chairs fold in one plane x (beach chair principle, director's chair) or in two planes x,y (camping chair, hunting chair) and have only one purpose.

To have a comfortable sitting position when visiting a beach or going camping a folding chair of some kind is commonly used, for example, a beach chair consisting of a stand with a fabric that folds together in one plane, or a camping chair that folds in two planes. The problem with the chairs available on the market is that they take too much space when folded and is therefore impractical to carry around.

PURPOSE OF THE INVENTION

The first purpose of the invention is to provide a children's furniture that can be changed to accommodate a baby's different daily routines such as sleeping, eating, sitting, and the various stages of development.

A second purpose is to provide a compact infant furniture, which has low weight and can be folded into a small volume in a simple way.

A third purpose is to create a piece of furniture for adults based on the same principle as the infant furniture, especially a compact folding and comfortable lounge chair to carry to the beach.

Problem Solving

The above purposes are achieved with a stand and a furniture according to subsequent patent claims distinguished parts.

TABLE OF FIGURES

FIG. 1. Shows Stand in its entirety in perspective

Figure 2A:
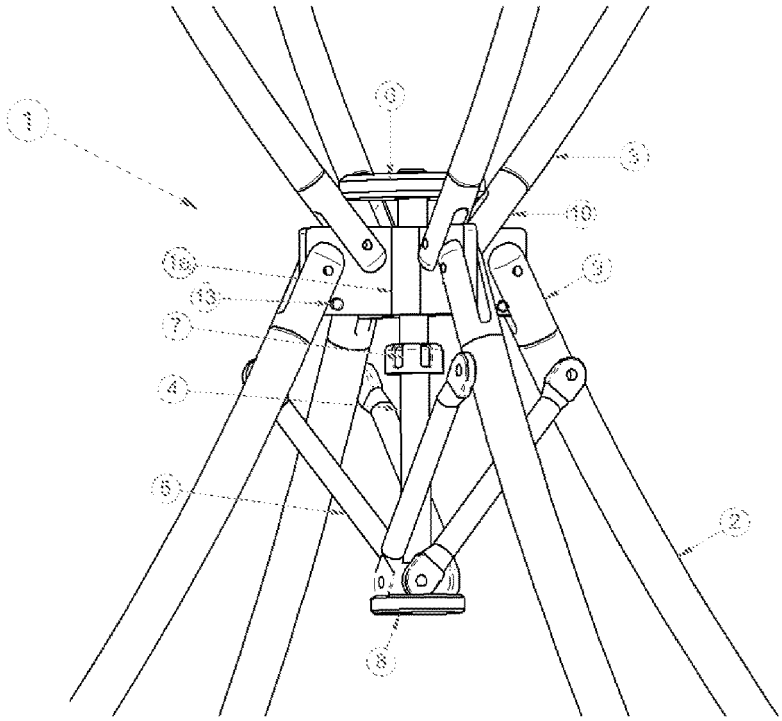

FIG. 2*a*. Shows in detail the locking and folding mechanism

Figure 2B:
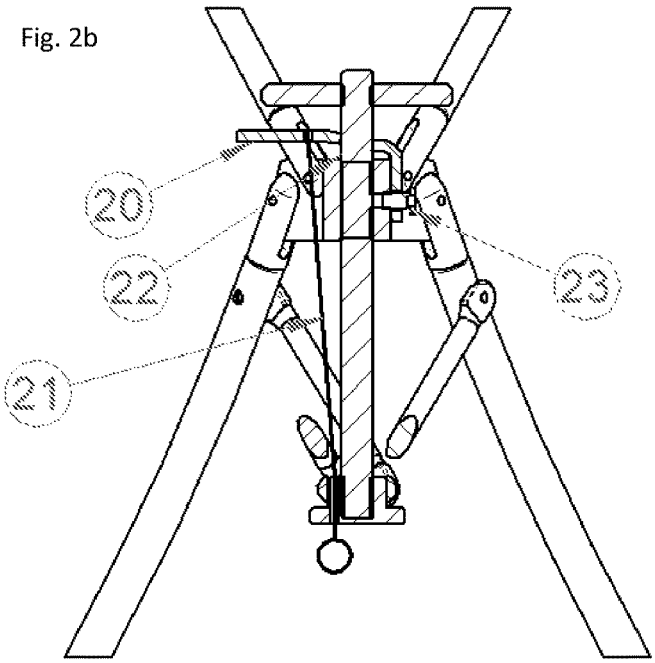

FIG. 2*b*. Shows FIG. 2*a* in cross-section but with a different locking mechanism FIG. 2*c*. Shows FIG. 2*a* but with a different locking mechanism FIG. 2*d*. shows stand in perspective with a different locking mechanism FIG. 2*e*. shows in detail a different locking mechanism (new)

Figure 3:
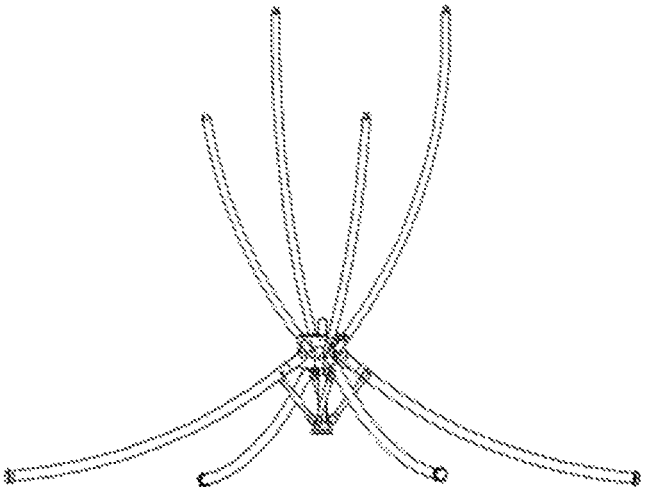

FIG. 3. Shows the stand in perspective in a low usage position

Figure 4:
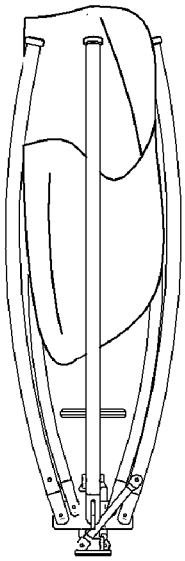

FIG. 4. Shows folded product with canvas module.

FIG. 5-8. shows different seating and lying canvas modules mounted on the stand.

Figure 5:
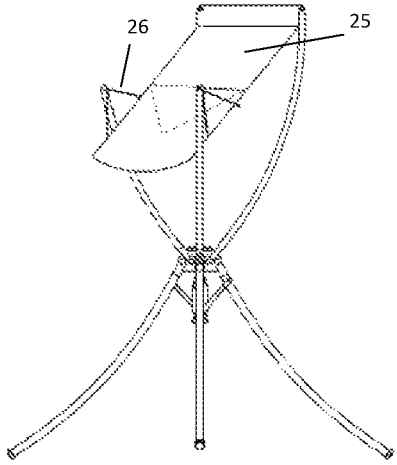

FIG. 5. Shows in perspective a embodiment of the invention in usage position (baby bouncer)

Figure 6:
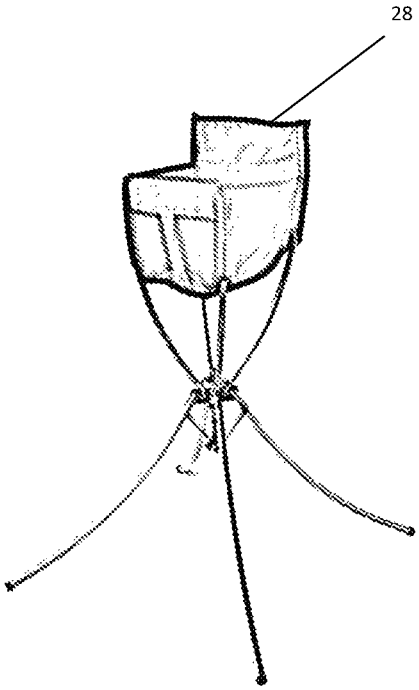

FIG. 6. Shows in perspective a second embodiment of the invention in usage position (high chair)

Figure 7:
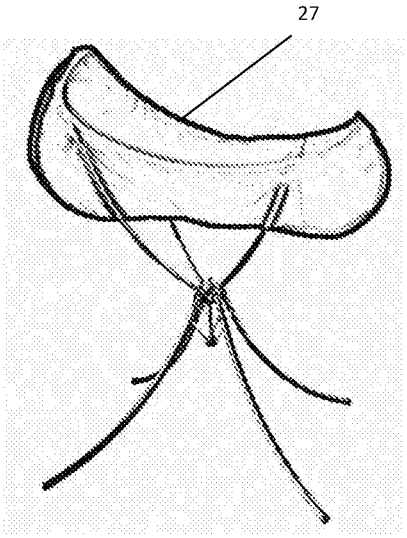

FIG. 7. Shows in perspective a third embodiment of the invention in usage position (infant bed/hammock)

Figure 8:
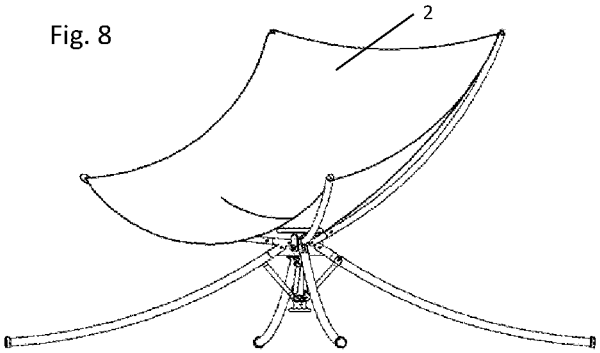

FIG. 8. Shows in perspective a fourth embodiment of the invention in usage position (lounge chair for adults or children)

DETAILED DESCRIPTION OF THE INVENTION

A piece of furniture according to the invention consists of at least three legs 2 and at least three arms 3 interconnected into a common connecting member in the form of a cylindrical hub 1*a* with a vertically axial through hole. Both legs and arms are pivotally attached to the hub via leg brackets 9 and arm brackets 10

Legs/arms can be curved or straight. Two of the arms are shorter than the other two arms to create an angle for attachment of sitting/lying module but all four arms can also be of equal length. Joining links 5 are attached to the side of the legs 2 and connecting the legs 2 to each other in a common adjustment member in the form of a link hub 8 which is attached to a rod 4. Said rod 4 runs through a vertical axial hole in the hub 1*a*.

Height adjustment of the furniture as well as folding is achieved by increasing/decreasing the angle between the legs and the hub.

The legs are locked to desired position by that the rod 4 alternatively the link hub 8 is locked axially relative to the hub 1*a* using a locking mechanism 7. Alternatively, the legs are locked directly to the hub 1*a* using sprints. A supporting member in the form of a vertically adjustable plate 6 is attached to the rod 4 with the purpose of preventing the arms 3 to be folded inward past a given angle when the sitting/sleeping module 25 FIG. 5 is carrying a load. There are restrictions on the hub 1*a* to limit the angle of the legs in the usage position, which limits the furniture's smallest footprint to ensure stability.

In the legs 2 ends are protective caps 11 with the purpose to protect the floor from scratches and in the arms 3 ends there are also caps 12 with radially through holes with the purpose to protect the sitting/lying module 25 FIG. 5 from damage as well as to serve as anchor for the spring element 26 FIG. 5 which make up the suspension to some variants of the sitting/lying module 25. Attachment of the suspension elements can also be done directly into the arms 3.

Above mentioned locking mechanism 7 can be in the form of a locknut 7 threaded on the rod 4 in accordance with FIG. 2*a*.

Above mentioned locking mechanism can also be in the form of glue gun mechanism in accordance with in FIG. 2*b*, consisting of a locking member 20 with a through hole that locks against the rod 4 by angular change. The locking member 20 is pivotally attached to the hub 1*a*. The locking member 20 is loaded with a spring at position 22 and/or 23. A string 21 is attached to the locking member 20, the string 21 runs through the link hub 8. The locking mechanism is unlocked by changing the angle of the locking member 20 relative the rod 4 either by pulling the string 21 or by pressing directly on the locking member 20.

Above mentioned locking mechanism can also be in the form of a locking member 31 that is pivotally connected to the hub in one end and engages in the rod 4 in another end. The locking of the rod relative the hub is released by changing the angle of said locking member which will disengage the locking member from the rod.

Figure 2C:
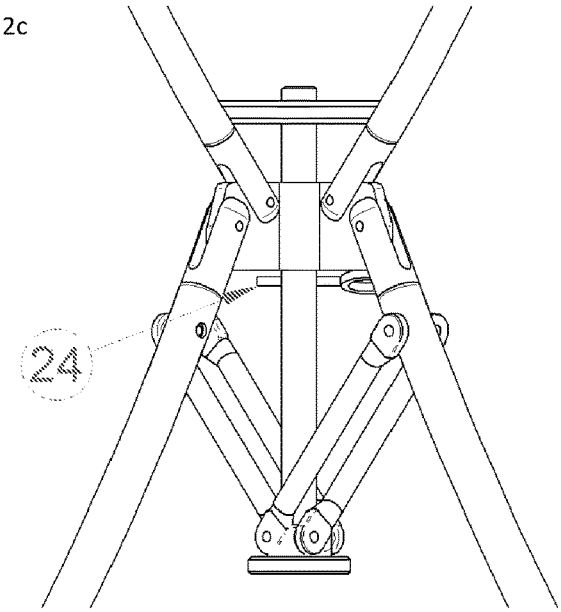

Above mentioned locking mechanism can also be in the form of a locking pin 24 in accordance with FIG. 2*c* where a locking pin 24 is placed through a horizontal hole in the rod 4.

Above mentioned locking mechanism can also be achieved by having the link hub 8 move freely along a rod 4 fixed to the hub 1*a* and then lock the link hub 8 relative to the rod 4 to achieve the locking of the legs.

Figure 2D:
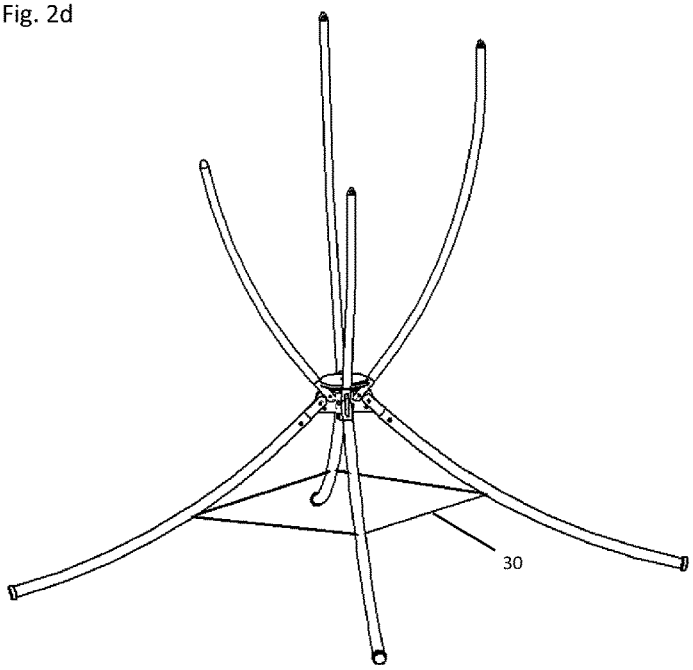
Figure 2E:
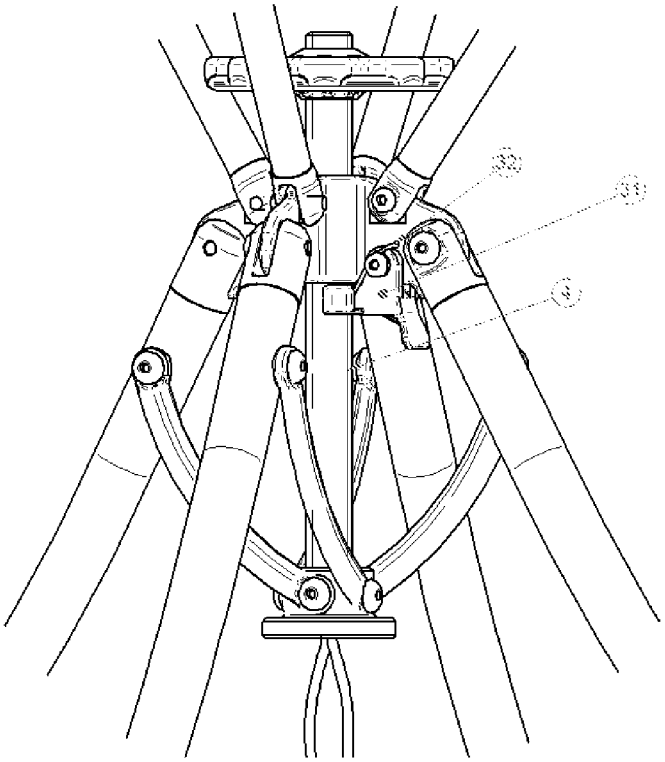

Above mentioned locking mechanism can also be achieved in accordance with FIG. 2*d* connecting the legs to each other by the use of a rope/string 30 and thereby preventing them from extending past a given point determined by the length of the rope. Folding is enabled by detaching the rope.

To customize the furniture's different applications, various flexible modules (i.e. canvas) 25,27,28,29, are mounted on the stand in accordance with FIG. 1 and provides the following applications. Bouncer FIG. 5, baby bed/hammock FIG. 6, High chair FIG. 7 and lounge chair FIG. 8. This furniture can also be used for adults but then in a larger size.

The application baby bouncer according to this invention consists of a stand with a module made of canvas 25 in accordance with FIG. 5. The canvas module is attached to the stand's four arms either inelastic or with an elastic element 26 in two or more anchor points. The sitting/lying module collapses when the furniture is folded.

The application infant bed according to the invention consists of a stand with a canvas module 27 in accordance with FIG. 6. The canvas module is attached to the stand's four arms either inelastic or with an elastic element in two or more anchor points. The lying module collapses when the furniture is folded.

The application high chair according to the invention consists of a stand with a canvas module 28 in accordance with FIG. 7. The canvas module is attached to the stand's four arms. The sitting module collapses when the furniture is folded.

The application lounge chair according to the invention consists of a stand with a canvas module 29 in accordance with FIG. 8. The canvas module is attached to the stand's four arms either inelastic or with an elastic element in two or more anchor points. The sitting/lying module collapses when the furniture is folded.

The invention claimed is:

1. A stand for a sitting or lying furniture, the stand comprising:

at least three legs, wherein the stand is adjustable in to at least a folded position for storage and transport and one or more extended/erect usage positions, wherein the at least three legs extend obliquely downward and outward when the stand is in the usage position; and at least three arms that extend obliquely upward and outward and are arranged to support a canvas shaped sitting or lying module when the stand is in the usage position, wherein bottom parts of the at least three arms and top parts of the at least three legs are pivotally connected to a connecting member, wherein a locking device attached to the connecting member is arranged to restrict the at least three legs from extending outward while the stand is in the usage position, and the at least three arms and the at least three legs extend substantially upward while the stand is in the folded position, wherein:

the connecting member comprises a hub with an envelope surface by which lower sections of the at least three arms and upper sections of the at least three legs are pivotally attached, one link arm is attached to each of the at least three legs such that one end of the link arm is pivotally attached to the leg below an upper end of the leg and another end of the link arm is pivotally attached with an axially relative to the hub, a movable link hub, and movement of the at least three legs between the storage/transport position and the usage position is controlled by axial displacement of the link hub relative to the hub, wherein the link hub comprises a rod that is axially movable through the hub, wherein the link arms are connected to said rod.

2. The stand according to claim 1, wherein the link hub comprises the rod connected to the hub and lower ends of the link arms are axially movable on the rod.

3. The stand according to claim 2, wherein a locking mechanism is arranged on the link hub.

4. The stand according to claim 3, wherein the locking mechanism comprises at least one radial hole through the rod and a pin, wherein the pin restricts the axial movement of the rod relative to the hub and thereby restricts the movement of the legs outward.

5. The stand according to claim 3, wherein the locking mechanism comprises a threaded section on the rod and a lock nut, wherein the lock nut restricts the axial movement of the rod relative to the hub and thereby restricts the movement of the legs outward.

6. The stand according to claim 3, wherein upper sections of the rod comprise a supporting member positioned above the hub that restricts the movement of the arms at least one of upward, inward, or upward and inward when the sitting or lying module mounted on the arms is loaded.

7. The stand according to claim 1, a locking mechanism comprising a spring loaded locking member that is attached to the hub and that has a hole, wherein the rod extends via the spring loaded locking member, and the spring loaded locking member is configured to be moveable between a position where the hole is horizontal and allows sliding of the rod and an oblique position where the spring loaded locking member locks the rod.

8. The stand according to claim 1, wherein a locking mechanism comprises a locking member that is pivotally connected to the hub via a first end of the locking member and is configured to engage with the rod via a second end of the locking member, wherein locking of the rod relative to the hub is released by changing the angle of said locking member which will disengage the locking member from the rod.

9. The stand according to claim 1, wherein a locking mechanism comprises removable mounted ropes interconnecting the legs, the removable mounted ropes restricting the legs from stretching outwards.

* * * * *